United States Patent [19]

Quinn, Jr.

[11] 4,000,401

[45] Dec. 28, 1976

[54] HYBRID MULTIVARIATE ANALOG FUNCTION GENERATOR

[75] Inventor: Neil R. Quinn, Jr., West Covina, Calif.

[73] Assignee: General Dynamics Corporation, Pomona, Calif.

[22] Filed: Oct. 20, 1975

[21] Appl. No.: 623,699

[52] U.S. Cl. ..... 235/150.53; 235/197

[51] Int. Cl.[2] ..... G06J 1/00; G06G 7/26

[58] Field of Search ..... 235/197, 150.53, 150.5

[56] References Cited

UNITED STATES PATENTS

| | | | |
|---|---|---|---|
| 3,373,273 | 3/1968 | Schubert | 235/197 |
| 3,480,767 | 11/1969 | Howe | 235/197 X |
| 3,513,301 | 5/1970 | Howe | 235/197 X |
| 3,557,347 | 1/1971 | Robertson | 235/197 X |
| 3,678,258 | 7/1972 | Patmore et al. | 235/197 X |
| 3,831,016 | 8/1974 | Nathan | 235/197 |

OTHER PUBLICATIONS

Rubin – "Hybrid Techniques for Generation of Arbitrary Functions," Simulation, Dec. 1966, pp. 293–308.

*Primary Examiner*—Joseph F. Ruggiero
*Attorney, Agent, or Firm*—Neil F. Martin; Edward B. Johnson

[57] ABSTRACT

Apparatus for generating an analog output F(x,y) according to the relationship $F_{ij}(x,y) = K_1(a_{ij} + b_{ij}x) + K_2((c_{ij} + d_{ij}x)\ y)$. The coefficients and the x and y values are supplied to the appartus by a digital computer. Interpolation circuitry compares sample $x$ and $y$ values to select the address in the $x$ and $y$ arrays corresponding to the $x$ and $y$ sample values. An analog part of the apparatus is fed the sample $x$ and $y$ values and the corresponding coefficients and produces the function F(x,y).

7 Claims, 6 Drawing Figures

HYBRID MULTIVARIATE ANALOG FUNCTION GENERATOR

BACKGROUND OF THE INVENTION

In the computer art, it is desirable in many instances, to employ the use of systems that have both digital and analog capabilities. Such systems are known as hybrid computers and permit the user to introduce both analog data, represented by indiscrete amplitude of electrical signals, and digital data represented by a coded sequence order of signals having only discrete states. In response to these two types of signal data, the hybrid computer performs analog and digital operations and integrates the separate operations by means of analog to digital or digital to analog converters. The advantage of the hybrid is the ability to solve problems wherein the input data are partially compatable with each of the analog and digital operations. Furthermore, it permits the generation of a visual representation of the output function.

One of the most important applications of hybrid is their ability to solve problems involving undefinable or difficult to define relationships. Therefore, it is useful to incorporate into hybrid systems, function generators that are capable of producing analog output functions in response to an independently varying analog input signal.

A prime example of the use of hybrids is in the aerospace industry in which aerodynamic characteristics of missile and airplane systems are determined by wind tunnel tests. It is often necessary to simulate these relationships in an analog computer. For example, angle of attack and mach number are independent variables that must be simulated in the hybrid to produce a continuous function that airframe designers can study to determine the effect of the parameters on a given system.

Any arbitrary mathematical function of one variable $F(x)$ can be represented to any degree of accuracy by a set of straight line segments $F(x)= a + bx$. This implies that each $F_i(x)$ can be represented as $a_i + b_i x$ where $a_i$ and $b_i$ are the intercept and slope of the ith straight line segment. The function $a + bx$ is easily implemented in hardware by the use of hybrid function generators composed of, such as a multiplying digital to analog converter (mdac), a digital analog converter (*dac*), and a summer. The function of the mdac is to multiply the continuous analog input $x$ by the digital value $b_i$ to form the continuous signal $bx$. The signal bx is then summed with the output of the dac to form $a + bx$. The mathematical derivation to extend this concept to functions of two variables is as follows:

$$1)\ F(x_i, y) = F(x_i, y_j) + \frac{y - y_j}{y_{j+1} - y_j}\,[F(x_i, y_{j+1}) - F(x_i, y_j)]$$

$$2)\ F(x_{i+1}, y) = F(x_{i+1}, y_j) + \frac{y - y_j}{y_{j+1} - y_j}\,[F(x_{i+1}, y_{j+1}) - F(x_{i+1}, y_j)]$$

To get $F(x,y)$ a linear interpolation between $F(x_i, y)$ and $F(x_i+_1, y)$ is performed resulting in $$3)\ F(x,y) = F(x_i, y) + \frac{x - x_i}{x_{i+1} - x_i}\,[F(x_{i+1}, y) - Fx_i, y)]$$

Carrying out the algebraic manipulations involved $$F(x,y) = K_1\,(a + bx) + K_2\,[(c + dx)y] \qquad 4)$$

Where $a$, $b$, $c$, and $d$ are functions of $x_i$, $x_{i+1}$, $y_j$ and $y_{j+1}$ and $K_1$ and $K_2$ are scaling constants.

Therefore if $x$ and $y$ lie in the ijth sector of the $xy$ grid $$F_{ij}\,(x,y) = K_1\,(a_{ij} + b_{ij}x) + K_2\,[(c_{ij} + d_{ij}x)y]. \qquad 5)$$

It should be observed that $F_{ij}$ is not a plain surface but rather a hyperboloid since it is constrained to pass through 4 points.

The prior art has been deficient in providing a hybrid system for producing an output that is a function of two independent variables, that is simple to use and efficiently processes the input data.

SUMMARY OF THE INVENTION

In an exemplary embodiment of the invention, $x$ and $y$ arrays and arrays of coefficients $a$, $b$, $c$ and $d$ are read into processing means in digital form. The processing means utilizes interpolation means to select the coefficients that correspond to sample $x$ and $y$ values. The generated function is a function of two independent variables according to the equation $$F(x,y) = K_1(a + bx) + K_2[(c + dx)y].$$

Sample $x$ and $y$ values and their corresponding $a_{ij}$, $b_{ij}$, $c_{ij}$ and $d_{ij}$ coefficients are applied to the analog part of the apparatus. A first multiplying digital to analog converter (mdac) means generates the quantity $b_{ij}\,x$, converting the signals from digital to analog form. A first digital to analog converter means (*dac*) generates the quantity $a_{ij}$, converting the signal from digital to analog form. A first summer means adds $b_{ij}$ and $a_{ij}$ to yield $a_{ij} + b_{ij}x$. A second mdac generates the quantity $d_{ij}x$. A second dac generates the quantity $c_{ij}$. A second summer means adds $d_{ij}x$ and $c_{ij}$ to yield $d_{ij}x + c_{ij}$. An analog multiplier generates the quantity $Y(d_{ij}x + c_{ij})$. Scaling means, such as potentiometer means apply scaling constants $K_1$ and $K_2$ to the quantities $a_{ij} + b_{ij}x$ and $Y(d_{ij}x + c_{ij})$. Finally, a third summer means adds these quantities to product $F_{ij}\,(x,y)$.

The digital portion of the apparatus receives the coefficients $a$, $b$, $c$ and $d$ arrays in eight bit words by means of a tape reader. Simultaneously, the $x$ and $y$ values are read into an input buffer. The reader places the arrays of $x$, $y$ and coefficient values in a coefficient buffer. Check sum logic means tallies the number of data words read into the function generator. The tally should equal the pre-set number, in this case 256, before proceeding with the function generation. In the event a false tally is obtained, such as by an imperfection or particle on the tape, the check sum logic means will prevent continuation of the function generation.

The $x$ and $y$ sample values are read into the $x$ and $y$ memory arrays. An exemplary embodiment utilizes a sixteen word array of twelve bits per word for the $x$ and $y$ arrays. The $a$, $b$, $c$, and $d$ coefficients are read into a coefficient memory array of $4 \times 256$ words, each of twelve bits. Sample $x$ and $y$ values are placed in the $x$ and $y$ analog to digital conversion means. The conversion means converts the $x$ and $y$ sample values to digital form and transfers them to $x$ and $y$ buffer storage means. The conversions and transfers are controlled by analog to digital control logic means. At the same time the analog to digital control logic means initiates conversions of the $x$ and $y$ sample values, the results of the previous analog to digital conversion are clocked into the $x$ and $y$ buffers. During the shadow of the present analog to digital conversion, the contents of $x$ and $y$ buffers are compared with the $x$ and $y$ arrays. The sample $x$ and $y$ values are placed in storage buffers, the comparisons are made in the $x$ and $y$ interpolation means respectively via the $x$ and $y$ buffers, to determine the addresses in the array of the $x$ and $y$ values corresponding to the sample $x$ and $y$ values. The interpolation means determines the values of $i$ and $j$ corresponding to $x_j$ and $y_j$. The values of i and j are then combined to form an address to the coefficient arrays to derive $a_{ij}$, $b_{ij}$, $c_{ij}$, and $d_{ij}$. The analog to digital converters generate end of conversion pulses that are synchronized by the analog to digital control logic means to form a single end of conversion pulse that clocks the coefficients into a coefficient output buffer. The sample $x$ and $y$ values and the $a_{ij}$, $b_{ij}$, $c_{ij}$, and $d_{ij}$ values are then applied to the analog portion of the function generator means and the function generation proceeds as has been described. The analog to digital control logic means reinitiates the sequence to address the coefficients corresponding to the next input $x$ and $y$ sample values. The process is continued generating $F(x,y)$, by applying sample $x$ and $y$ values and the output function may be presented in a visual display.

It is therefore an object of the invention to provide a new and improved hybrid multivariate analog function generator.

Another object of the invention is to provide a new and improved hybrid multivariate analog function generator for the generation of arbitrary electronic functions of two independent variables.

Another object of the invention is to provide a new and improved hybrid multivariate analog function generator that is self contained in a single unit receiving coefficient input information from external digital equipment.

Another object of the invention is to provide a new and improved hybrid multivariate analog function generator that is compact, efficient and of simple construction.

DETAILED DESCRIPTION OF THE DRAWINGS

Figure 1:
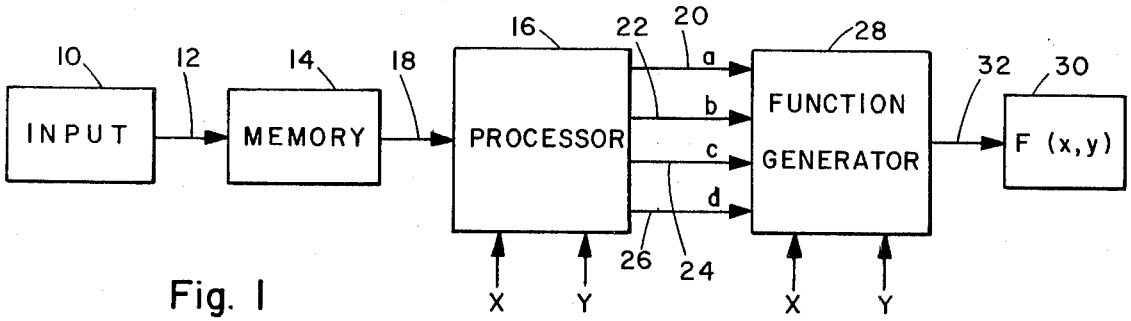
FIG. 1 is a schematic diagram of the primary component functions of the invention.
Figure 6:
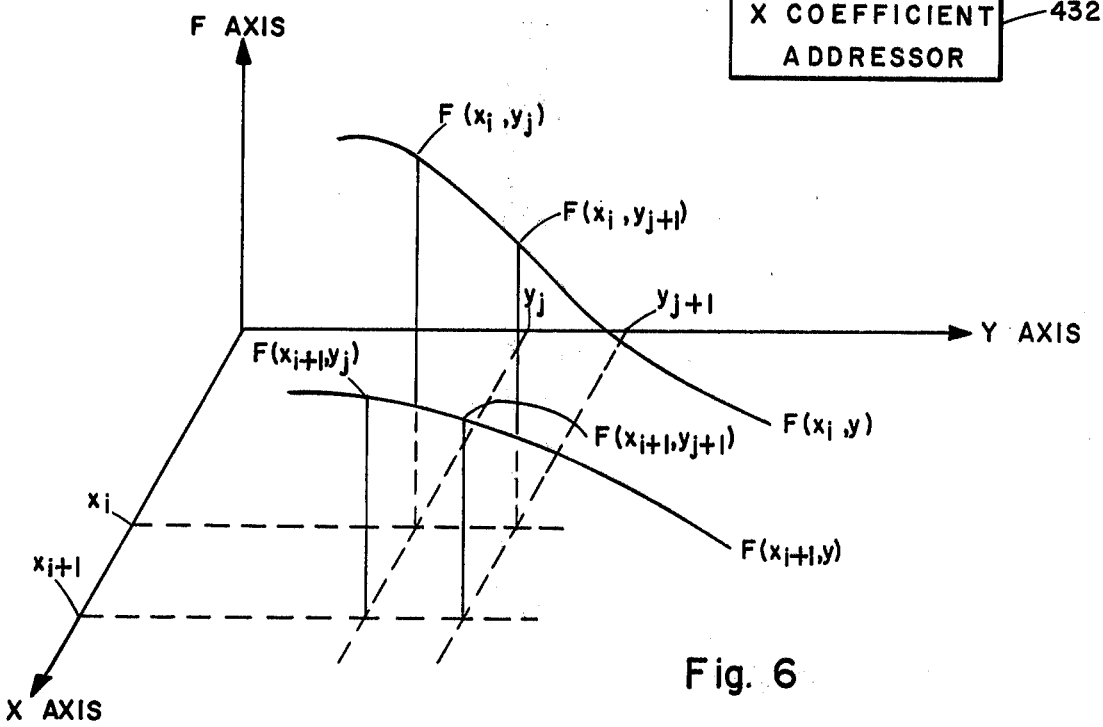
FIG. 6 is a fragmentary portion of a graphically represented function to two variables.

An exemplary embodiment of the invention which constructs a function, as in FIG. 6 in its most basic functional analysis comprises input means 10 that via line 12 feeds the input information into the memory means 14, as in FIG. 1. The values $x$, $y$, $a$, $b$, $c$, and $d$ are initially encoded onto a paper tape by means of a program on a digital computer. The various values are then read into associated arrays in memory 14. The processing means 16 is fed sample $x$ and $y$ values, and also selectively receives the information from memory 14 via line 18. It is the function of the processor means 16 to select the coefficients $a$, $b$, $c$, and $d$ corresponding to the $x$ and $y$ sample values fed into that means. The processing means 16 having selected the coefficients corresponding to the sample $x$ and $y$ values, transfers them via the lines 20, 22, 24, and 26 to the function generator means 28. The function generator means 28 is fed the sample $x$ and $y$ values and combines those values along with the selected coefficients to produce $F(x, y)$. The values of $F(x,y)$ is fed to a display unit 30 via line 32. In the function generating mode, the sequence of events is repeated indefinitely.

Figure 5:
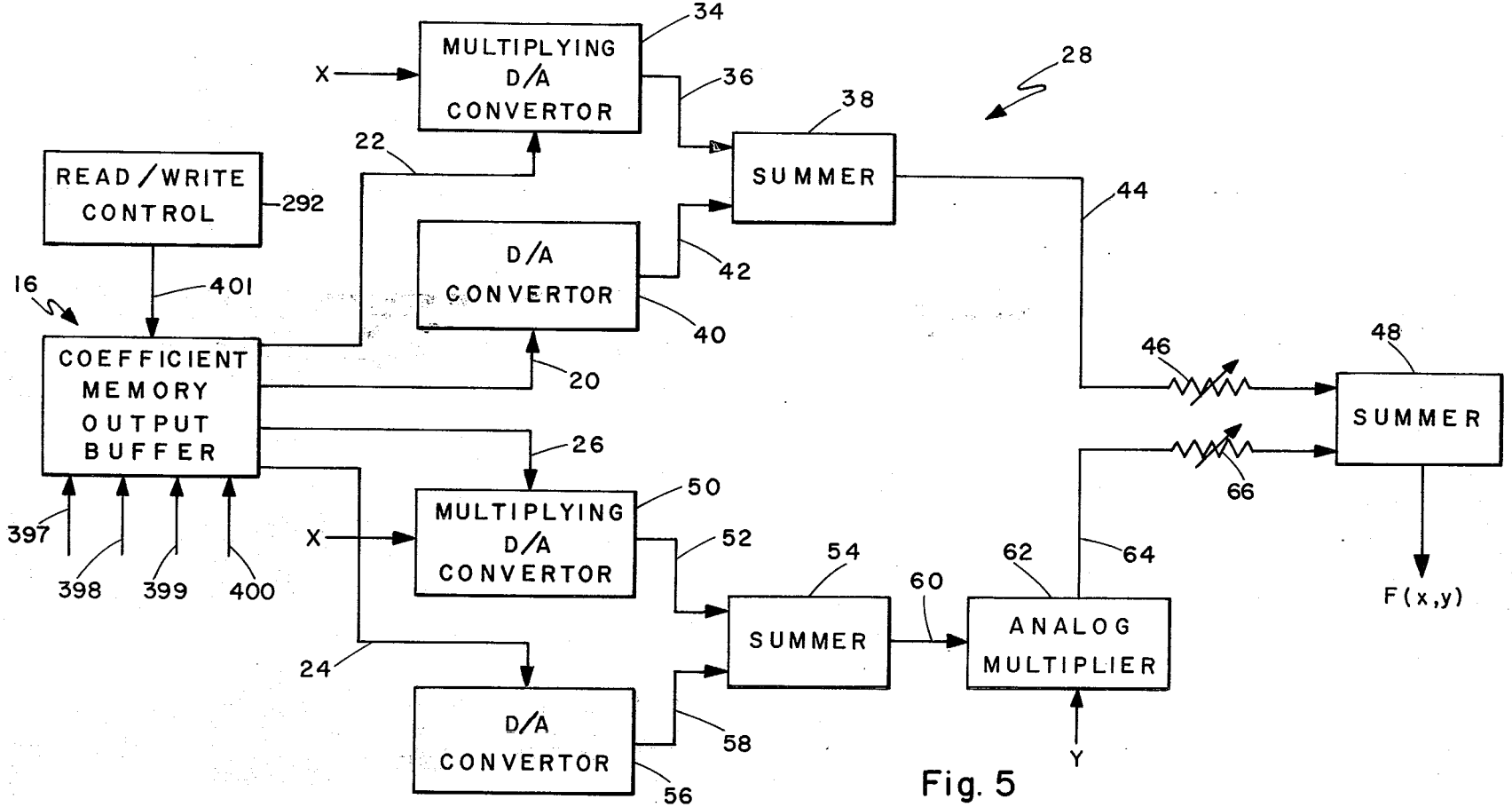
FIG. 5 is a schematic diagram of the function generator means interfaced with the coefficient output buffer.

Turning to FIG. 5 the function generating means 28 is illustrated. The function generating means 28 received its coefficient information from the processing means 16 in the form of digital pulses representing values for the $a$, $b$, $c$, and $d$ coefficients. The processing means 16 is also fed $x$ and $y$ values that are provided as analog information. A first multiplying digital to analog converter 34 multiplies the analog $x$ information by the converted $b_{ij}$ information to produce the sum $b_{ij}x$. The signal representing the quantity $b_{ij}x$, is fed via line 36 to a first summer means 38. The signal $a_{ij}$ is fed to a first digital to analog converter 40, the function of which is to convert the digital signal to an appropriate analog signal. The analog signal representing $a_{ij}$ is fed via line 42 to the first summer means 38. The first summer means 38 adds the signals $b_{ij}x$ and $a_{ij}$ to produce a signal representing the quantity $b_{ij}x+a_{ij}$. This signal is passed, via line 44 to a first scaling means 46. The first scaling means 46 is a potentiometer that appropriately scales the signal in line 44. From the scaling means 46 the signal is passed to a third summer means 48. A second multiplying digital to analog converter 50 receives the digital $d_{ij}$ and combines that signal with the analog $x$ signal to produce the signal representing the quantity $d_{ij}x$, in analog form. That signal via line 52 is passed to a second summer means 54. A second digital to analog converter 56 receives the signal $c_{ij}$ in digital form and passes the same via line 58 to the second summer means 54. The second summer means sums the two signals and produces the signal representing the quantity $d_{ij}x + c_{ij}$. That signal is fed via line 60 to an analog multiplier 62. The analog multiplier 62 multiplies the signal representing $d_{ij}x + c_{ij}$, times the analog signal $y$. The resultant signal is fed via line 64 to the second scaling means 66 that appropriately scales the signal representing the quantity $(d_{ij}x + c_{ij})y$. Finally the third summer means 48 produces a sum of the signals received from the scaling means 46, 66. The resultant signal represents $F(x, y)$ that mathematically is equivalent to $K_1(a_{ij}+b_{ij}x)+K_2(c_{ij}+d_{ij}x)y$, wherein $K_1$ and $K_2$ are scaling constants corresponding to the settings of the scaling means 46, 66.

Figure 2:
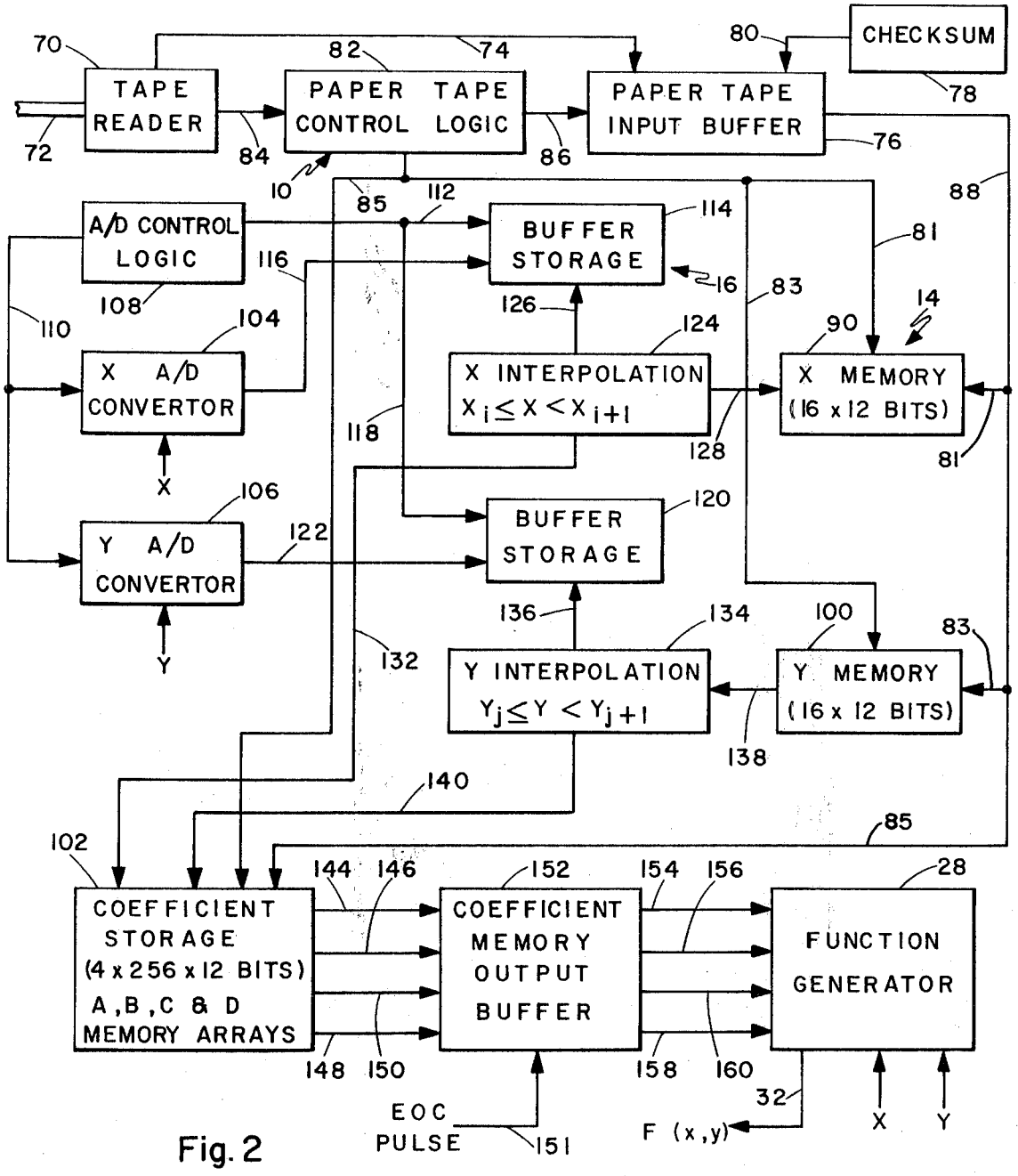
FIG. 2 is a schematic diagram of some of the major components incorporated in the diagram of FIG. 1.

Turning now to FIG. 2, the processing means 6, is illustrated in greater detail. Specifically, the diagram of FIG. 2 illustrates the manner in which the addressed coefficients $a$, $b$, $c$, and $d$ are selected in conjunction with sample input $x$ and $y$ values. A tape reader 70 is fed the $x$, $y$ and coefficient arrays via the paper tape designated as numeral 72. The information from the paper tape reader 70 is fed via line 74 into the paper tape input buffer 76. Check sum logic means 78, via line 80 insures that only the proper number of data points are read from the paper tape 72. This insures that in the event of a tape imperfection or dirt particle on the tape 72, the processing will discontinue so as to avoid an incorrect result. The paper tape control logic means 82 is connected via line 84 to the paper tape reader 70. The paper tape control logic means 82 via line 86 controls the input of information into the paper tape input buffer 76, and also properly steers that information to the correct memories. The information on line 88 from the input buffer 76 is steered into the appropriate $x$ memory means 90, $y$ memory means 100 or the coefficient storage means 102 via lines 81, 83 and 85 respectively. Sample analog values of the $x$ and $y$ are fed into $x$ analog to digital converter means 104 and $y$ analog to digital converter means 106. Those converter means 104, 106 are of conventional construction and incorporate conventional sample and hold amplifiers. The analog to digital control logic means 108, via line 110 controls the operation of the analog to digital converters 104, 106 that convert the sample $x$ and $y$ signals into appropriate digital signals. The analog to digital control logic means 108 also connects, via line 112, to the $x$ buffer storage means 114. The analog to digital control logic means 108 controls the delivery of signals from the $x$ analog to digital converter 104 to the $x$ buffer storage means 114 via line 116. In a similar manner, the analog to digital control logic means 108 is connected. via line 118, to the $y$ buffer storage means 120. It controls the passage of signals, from the $y$ analog to digital converter means 106 to the $y$ buffer storage means 120 via line 122. The $x$ interpolation circuitry means 124, via line 126 looks at the value in the $x$ buffer storage means 114. It also looks, via line 128 at the $x$ memory array means 90, and compares the two values of $x$. It continues in this comparison mode until it selects the values from the $x$ memory means 90 that are closest to the value of $x$ passed to digital converter means 104. The $x$ interpolation means in effect produces two values from the $x$ memory array means 90 such that $x_i$ is less than or equal to $x$ which is less than or equal to $x_{i+1}$. The $i$ address having been established, the signal representing that address is passed via line 132 to the coefficient storage means 102. Similar processes occur with the $y$ interpolation circuitry 134. That circuitry, via line 136 looks at the value in the $y$ buffer storage means 120. Also, it looks via line 138 at the $y$ memory array means to establish the closest values in the $y$ memory array means 100 to the sample $y$ value. The processing in the $y$ interpolation circuitry means continues until the $j$th address is established and that address via line 140 is passed to the coefficient storage means 102. The coefficient storage means 102 are then addressed to select the coefficients $a$, $b$, $c$, and $d$ corresponding to the selected $ij$th address. Those coefficients via lines 144, 146, 148, 150 are input into the coefficient memory output buffer means 152. Upon receiving the appropriate end of conversion pulse 151 the coefficient memory output buffer means 152, via the lines 154, 156, 158, and 160 pass the signals representing the addressed coefficients to the function generator means 28. That means as previously stated appropriately combines the addressed coefficients, converting them into analog information with the sample $x$ and $y$ values to produce $F(x,y)$.

Figure 3:
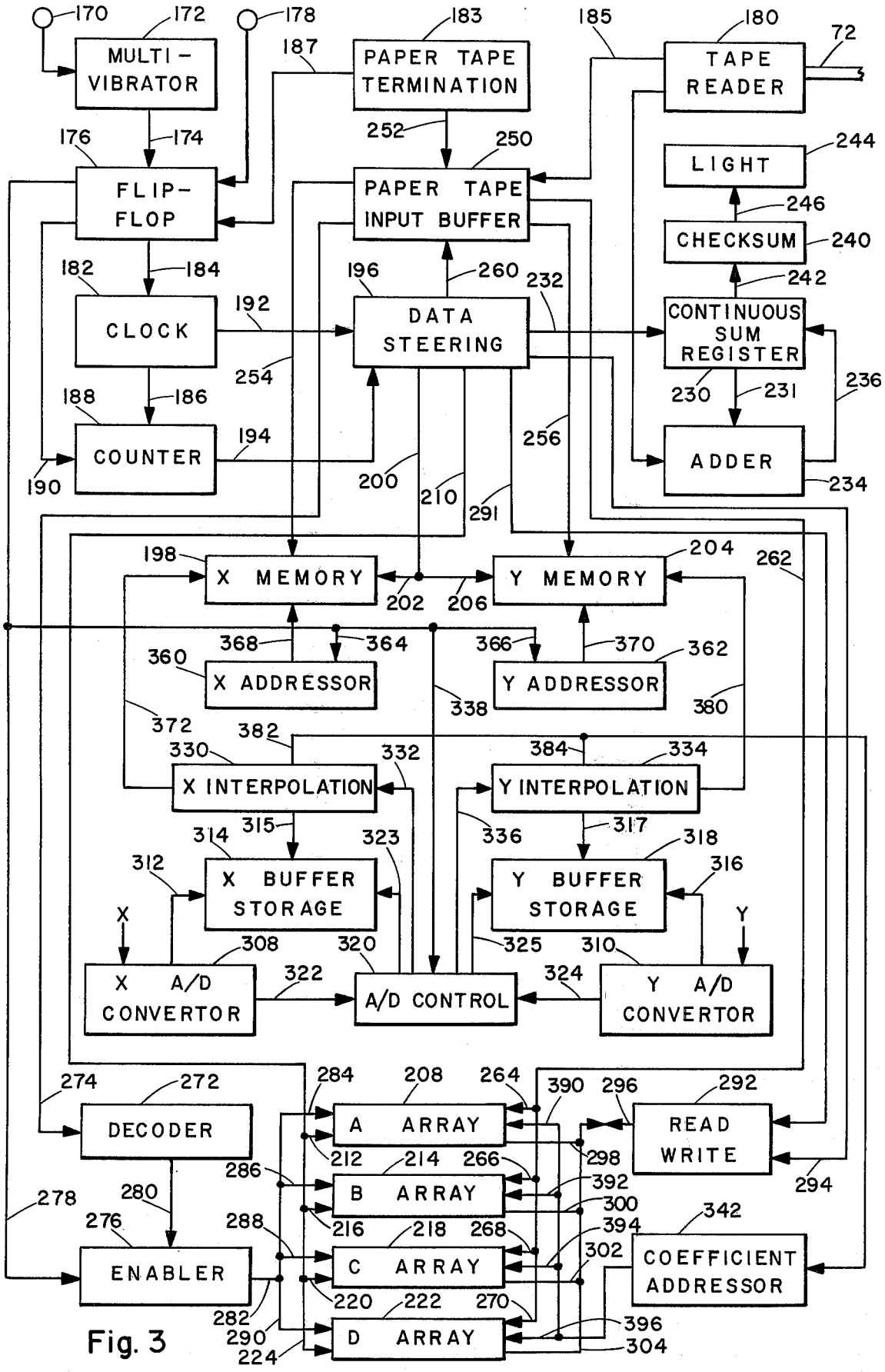
FIG. 3 is a detailed schematic diagram of the circuitry components of FIG. 2.

Turning now to FIG. 3, the general functions described in association with the description of FIG. 2, are expanded to illustrate the specific manner of processing the information. Specifically, FIG. 3 is directed to the detailed circuitry that comprises the processing means 16. It should be understood that the circuitry illustrated in FIG. 3 represents only one manner or producing the results described in association with FIGS. 1, 2 and 5. The operator by pressing the load button 170 initiates the loading sequence. The monostable-multivibrator 172, of a one second duration, is triggered by the load button 170 and insures against contact bounce of that load button 170. The multivibrator via line 174 enables the flip-flop 176 that indicates the present condition (load or run) of the unit. The flip-flop 176 is placed into the load status condition by the monostable-multivibrator 172. It is placed in the run status condition by either the reset button 178 pushed by the operator or can also be placed in the run status by sensing the presence of a termination character on the paper tape reader 180. The paper tape input buffer 250 enables the paper tape termination 183, via line 252. The signal representing the termination character on the paper tape 72 is passed via line 187 from the paper tape termination 183. The paper tape reader 180 controls logic is provided by means of the clock 182 that is enabled by the load line 184 from the flip-flop 176. The clock 182 comprises two monostable multivibrators connected to be a bistable multivibrator. The flip-flop 176 via the load line 190 enables a counter 188. The clock 182 provides the clock pulses for the counter 188. The counter 188 comprises two flip-flops connected to be a modulo 3 counter. The clock 182 via line 192, and the counter 188 via line 194 provide input signals to the data steering 196. The data steering 196 decodes the state of the modulo 3 counter to generate the necessary clock signals for the proper loading of the $x$ memory 198, via lines 200, 202, the $y$ memory 204, via lines 200 and 206, the $a$ memory aray 208 via lines 210, 212, the $b$ memory array 214, via line 216, the $c$ memory 218, via line 220, and the $d$ memory array 222, via line 224.

The unit incorporates check sum logic means 240 to insure that the data is properly read by the paper tape reader 180. It is possible for tape imperfection or dust particle to cause an improper processing of the data. Therefore, the check sum logic means 240 keeps a continuous sum of all characters read from the paper tape 72. Accordingly, a continuous sum register 230 is enabled by the data steering 196, via line 232. The continuous sum register 230 comprises an eight bit register. An eight bit adder 234, via line 236 and the return line 231 adds the eight bit character just read from the paper tape 72 to the sum contained in the continuous sum register 230. Upon completion of the loading process, the contents of the continuous sum register 230 are designed to sum to zero. This is accomplished by making the last character on the paper tape the negative of the sum of all the previous characters. The check sum means 240, enabled via line 242, determines if the contents of the continuous sum register 230 are equal to zero at the completion of the loading process. If they are nonzero, an indicator light 244 is enabled via line 246 and it provides a visual indicator on a control panel that a reader error has occurred. A paper tape input buffer 250 receives input information, via line 185, from the paper tape reader 180. The paper tape input buffer 250 comprises a 24 bit register and, via lines 254, 256 it transfers the input $x$ and $y$ data values to the $x$ memory 198 and y memory 204 respectively. The paper tape input buffer 250 receives its control signals, via line 260, from the data steering 196. It also functions to transfer the input coefficient values to the $a$ memory array 208 via lines 262 and 264, to the

*b* memory array 214, via line 266, to the *c* memory array 218, via line 268 and to the *d* memory array 222, via line 270.

The coefficient memory arrays 208, 214, 218 and 222 are all identical. During the loading process a decoder 272 is enabled via line 274 by means of the paper tape input buffer 250. The decoder 272 decodes which memory is to be loaded. An enabler 276 is enabled via line 278, that is a run line from the flip-flop 176. By means of control signals passed from the decoder 272 via line 280, the enabler 276 enables only one memory array at a time during the loading process and enables all the memories during the run process via lines 282 and 284 to the *a* memory array 208, line 286 to the *b* memory array 214, line 288 to the *c* memory array 218, and line 290 to the *d* memory array 222. The data steering 196, via line 291 enables a read write control 292. The read write control 292 receives the input information from the data steering 196 via line 294 and during the load process enables that information into the coefficient memory arrays. The information in the paper tape input buffer is steered via lines 296 and 298 in the *a* memory array 208, via line 300 in the *b* memory array 214, via line 302 in the *c* memory array 218, and via line 304 in the *d* memory array 222 by the read write control 292 and the enabler 276.

Analog signals representing sample *x* and *y* values are incident on an *x* analog to digital converter 308 and a *y* analog to digital converter 310. The *x* converter 308 and the *y* converter 310 include conventional sample and hold amplifiers. The A/D control 320 via line 323 enables the information in the *x* A/D converter 308 into the *x* buffer storage means 314 via 312. The A/D control 320 via line 325 enables the information in the *y* A/D converter 310 into the *y* buffer storage means 318 via line 316. An analog to digital control logic means 320 controls the sequence of the conversions and the signal passage via lines 323 and 325 to the *x* and *y* buffer storage means 314 and 318. The analog to digital control logic means 320 comprises two flip-flops "ANDed" together to determine when both the *x* and *y* end of conversion signals are received from the *x* converter 308, via line 322 and the *y* converter 310, via line 324. When the output of this AND function becomes true it initiates a timing sequence controlled by three monostable multivibrators connected serially. This sequence provides control signals to the *x* interpolation means 330, via line 332 and the *y* interpolation means 334, via line 336. The analog to digital control logic means 320 is initially enabled by means of the load signal in line 338 from the flip-flop 176. The *x* and *y* interpolators 330 and 334 function to find an *i* such that $x_i$ is less than or equal to *x*, and is less than $x_{1+1}$. X is the value converted on the x analog to digital converter 308 and $x_i$ and $x_{1+1}$ are two consecutive breaks points in the *x* memory array. The *x* and *y* memories 198, 204 are addressed by the *x* and *y* addressors 360, 362. The *x* and *y* addressors are enabled by the lines 364 and 366 respectively that are connected by the run line 338 to the flip-flop 176. The *x* and *y* addressors 360, 362 via lines 368 and 370 respectively determine which address (read or load) to apply to the *x* and *y* memories 198, 204. The *x* interpolator, 330 via line 372 looks at the *x* memory 198 and the values from the *x* buffer storage 314 via line 315 to obtain the values for *x* during the interpolation process. The *y* interpolator 334 performs the same function via line 380 from the *y* memory 204 and via line 317 from *y* buffer storage 318. After completing the interpolations, the *x* and *y* interpolators produce *i*th and *j*th addresses. Those addresses are applied to the coefficient addressor 342, via lines 382 from the *x* interpolator 330, and 384 from the *y* interpolator 334. The coefficient addressor 342 combines the *i*th and *j*th addresses and via line 390 addreses the *a* memory array 208, via the line 392 addresses the *b* memory array 214, via line 394 addresses the *c* memory array 218 and via line 396 addresses the *d* memory array 222. The coefficients at those addresses are then passed into the coefficient memory output buffer 16 via line 397, 398, 399 and 400 (FIG. 5). The read write control 292, via line 401 (FIG. 5) controls the transfer of the addressed coefficient in to the function generator means 28 for processing that has previously been described.

Figure 4:
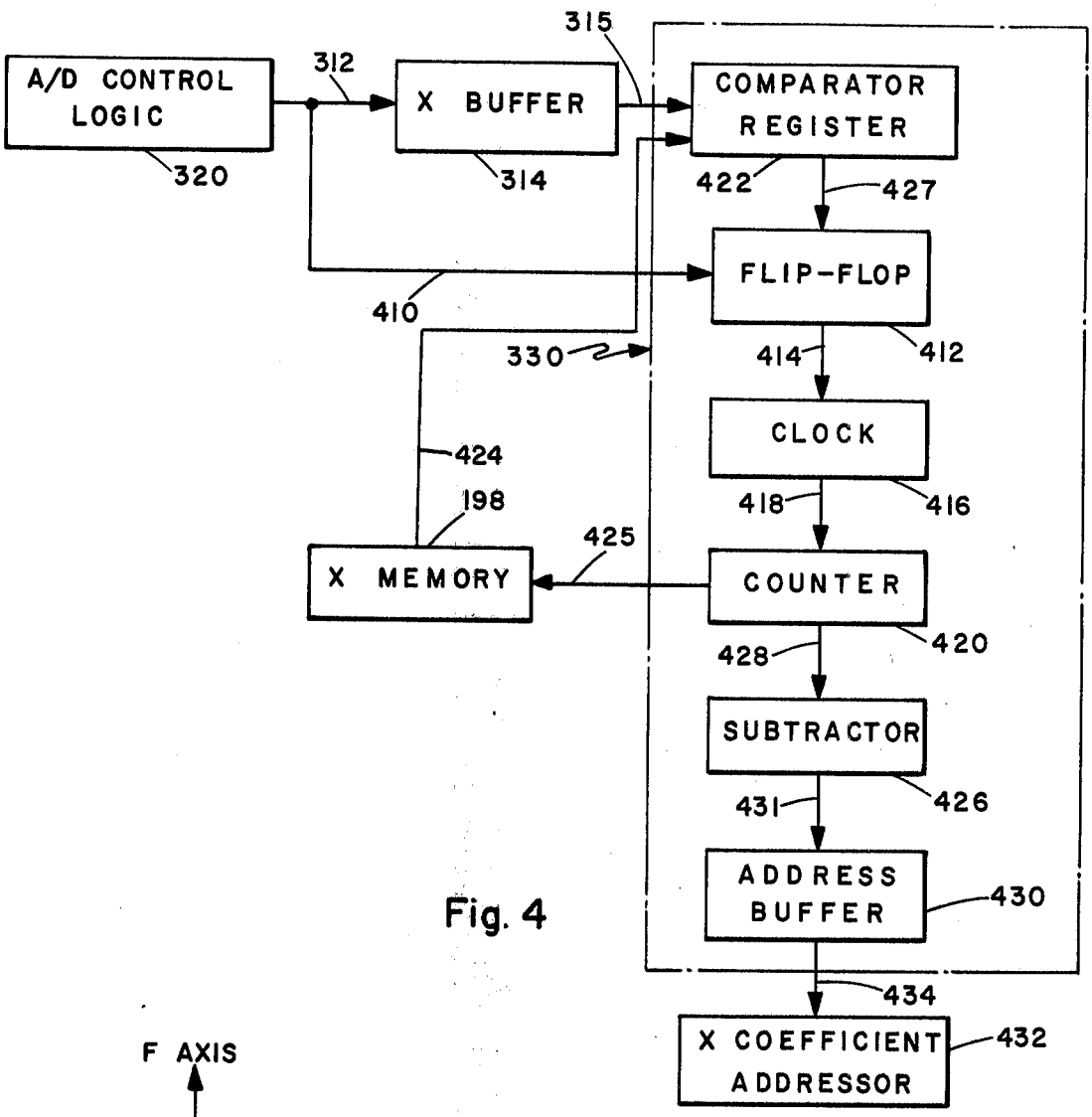
FIG. 4 is a schematic diagram of the interpolation means.

FIG. 4 illustrates in detail the process of interpolation that is conducted in the *x* and *y* interpolators 330 and 334. FIG. 4 only illustrates in detail an *x* interpolator 330 and it is to be understood that the *y* interpolator is identical. A wait signal from the analog to digital control logic 320 is passed via line 312 to the *x* buffer means 314 and via line 410 to the flip-flop 412. Flip-flop 412 via line 414 enables the clock 416. The clock 416 via line 418 clocks counter 420. Counter 420 supplies the address of a word in the *x* memory array 198 via line 425. The word addressed in the *x* memory array 198 is compared to the value in the *x* buffer storage 314 via line 315 in the comparator register 422 via the line 424. If the value of the word in the *x* memory array 198 is greater than or equal to the value in the *x* buffer storage 314 then flip-flop 412 is reset via line 427 thus shutting off clock 416. Otherwise the clock 416 continues to clock the counter 420. When the interpolation process is terminated, counter 420 contains the count $i + 1$. Since it is desired to have the count of $i$ rather than $i + 1$, 1 is subtracted from counter 420 by the subtractor 426 via line 428. The result of the subtraction is stored in an address buffer 430 via line 431 that is a four bit register that retains the value of $i$ until completion of the next interpolation process. The value of $i$ is supplied to the *x* coefficient addressor 432 via line 434 so that the coefficients in the various coefficient arrays may be addressed and applied to the function generator means 28. It is to be understood that precisely the same sequence of operations applies to the *y* interpolation procedure.

Although the apparatus has been described in conjunction with a function of two independent variables, it should be understood that the invention contemplates use in solving an equation of more than two independent variables. For instance, a function of three independent variables having eight coefficients could be produced by adding memory, interpolating, buffer and the other related components.

Having described my invention, I now claim:

1. Apparatus for generating an analog output signal in accordance with a desired function of at least two independent variables, comprising:

memory means for storing arrays of a first independent variable, a second independent variable, and first, second, third and fourth coefficients corresponding to combinations of said first and second independent variables at predetermined intervals;

input means for placing sample first and second independent variable signals into the apparatus;

processing means for comparing said sample first and second independent variable signals with said stored first and second independent variable arrays to select addresses in said stored arrays of coefficients corresponding to combinations of said sample independent variable signals; and function generator means responsive to the processing means for combining digital signals representing said coefficients at said selected addresses with said sample independent variable signals to produce a continuous analog output signal, said function generator means comprising first digital to analog converter means for converting said first coefficient signal into a first analog signal, first multiplying digital to analog converter means for multiplying said second coefficient signal times said sample first variable signal to produce a second analog signal, first summer means for producing a third analog signal representing the sum of said first and second analog signals, second digital to analog converter means for converting said third coefficient signal into a fourth analog signal, second multiplying digital to analog converter means for multiplying said fourth coefficient signal times said sample first variable signal to produce a fifth analog signal, second summer means for producing a sixth analog signal representing the sum of said fourth and fifth analog signals, analog multiplier means for multiplying said sixth analog signal by said sample second variable signal to produce a seventh analog signal, and third summer means for producing a said continuous analog output signal representing the sum of said third and seventh analog signals, thereby providing said desired function at said selected addresses corresponding to said sample first and second independent variable signals; and wherein said processing means comprises:

first buffer storage means for storing said sample first variable signal, second buffer storage means for storing said sample second variable signal, first interpolation means for comparing said sample first variable signal in the first buffer storage means with said stored first independent variable array to determine the address in said stored first independent variable array corresponding to said sample first variable signal, second interpolation means for comparing said sample second variable signal in the second buffer storage means with said stored second independent variable array to determine the address in said stored second independent variable array corresponding to said sample second variable, and coefficient addressor means for combining said determined addresses corresponding to said sample first and second independent variable signals to select the addresses of said corresponding coefficients.

2. An apparatus according to claim 1, wherein said processing means further comprises:

first analog to digital conversion means for converting said sample first variable signal and placing said converted signal in said first buffer storage means;

second analog to digital conversion means for converting said sample second variable signal and placing said converted signal in said second buffer storage means; and analog to digital control logic means for initiating said conversion in the first and second analog to digital conversion means and for simultaneously clocking the results of the previous analog to digital conversions into the first and second buffer storage means.

3. An apparatus according to claim 2, wherein said processing means further comprises:

coefficient memory output buffer means interfacing with said function generator means for storing said digital signals representing said coefficients at said selected addresses.

4. An apparatus according to claim 3 wherein said first and second analog to digital conversion means generate end of conversion pulses that are synchronized by the analog to digital control logic means to form an end of conversion pulse that clocks said signals representing said coefficients into the coefficient memory output buffer means and reinitiates said process of selecting said addresses in said stored arrays of coefficients corresponding to the next input combination of sample first and second variable signals.

5. An apparatus according to claim 3 wherein the function generator continuously receives the signals in the coefficient memory output buffer means for producing said continuous analog output signal.

6. An apparatus according to claim 1 further comprising:

scaling means for biasing the signals generated by said first summer means and said analog multiplier means prior to applying those signals to said third summer means.

7. A method of generating an analog output signal in accordance with a desired function of at least two independent variables, comprising:

storing arrays of a first independent variable, a second independent variable, and first, second, third and fourth coefficients corresponding to combinations of a said first and second independent variables at predetermined intervals;

inputting sample first and second independent variable signals;

processing said input signals by comparing said sample first and second independent variable signals with said stored first and second independent variable arrays to select addresses in said stored arrays of coefficients corresponding to combinations of said sample independent variable signals; and generating an analog output signal by combining digital signals representing said coefficients at said selected addresses with said sample independent variable signals to produce a continuous analog output signal, said generating step comprising:

converting said first coefficient signal into a first analog signal, multiplying said second coefficient signal times said sample first variable signal to produce a second analog signal, producing a third analog signal representing the sum of said first and second analog signals, converting said third coefficient signal into a fourth analog signal, multiplying said fourth coefficient signal times said sample first variable signal to produce a fifth analog signal, producing a sixth analog signal representing the sum of said fourth and fifth analog signals, multiplying said sixth analog signal by said sample second variable signal to produce a seventh analog signal, and producing a said continuous analog output signal representing the sum of the third and seventh analog signals, thereby providing said desired function at said selected addresses corresponding to said sample first and second independent variable signals; and wherein said processing step comprises:

storing said sample first variable signal, storing said sample second variable signal, comparing said stored sample first variable signal with said stored first independent variable array to determine the address in said stored first independent variable array corresponding to said sample first variable signal, comparing said stored sample second variable signal with said stored second independent variable array to determine the address in said stored second independent variable array corresponding to said sample second variable, and combining said determined addresses corresponding to said sample first and second independent variable signals to select the addresses of said corresponding coefficients.

* * * * *